US011225788B2

(12) United States Patent
Sakaguchi et al.

(10) Patent No.: US 11,225,788 B2
(45) Date of Patent: Jan. 18, 2022

(54) ROOF STRUCTURE AND CONSTRUCTION METHOD THEREOF

(71) Applicant: SHIKOKU CHEMICALS CORPORATION, Kagawa (JP)

(72) Inventors: Koji Sakaguchi, Kagawa (JP); Shinji Sagawa, Kagawa (JP)

(73) Assignee: SHIKOKU CHEMICALS CORPORATION, Kagawa (JP)

( * ) Notice: Subject to any disclaimer, the term of this patent is extended or adjusted under 35 U.S.C. 154(b) by 28 days.

(21) Appl. No.: 16/638,743

(22) PCT Filed: Aug. 22, 2018

(86) PCT No.: PCT/JP2018/031044
§ 371 (c)(1),
(2) Date: Feb. 12, 2020

(87) PCT Pub. No.: WO2019/044632
PCT Pub. Date: Mar. 7, 2019

(65) Prior Publication Data

US 2021/0131091 A1 May 6, 2021

(30) Foreign Application Priority Data

Aug. 30, 2017 (JP) ..... JP2017-165040
Feb. 19, 2018 (JP) ..... JP2018-026863

(51) Int. Cl.
*E04B 1/34* (2006.01)
*E04H 1/12* (2006.01)
*E04H 6/02* (2006.01)

(52) U.S. Cl.
CPC ..... *E04B 1/3404* (2013.01); *E04H 1/1205* (2013.01); *E04H 6/025* (2013.01)

(58) Field of Classification Search
USPC ..... 52/28, 73, 90, 221, 463
See application file for complete search history.

(56) References Cited

U.S. PATENT DOCUMENTS 5,109,643 A * 5/1992 Speers ..... E04B 7/00 52/220.3
9,822,528 B1 * 11/2017 Greenblatt ..... E04H 6/005
(Continued)

FOREIGN PATENT DOCUMENTS

FR 2142608 A1 2/1973
JP S44-5067 U 2/1969
(Continued)

OTHER PUBLICATIONS

Bluetop Solar Carport, "transform your parking area into a comfortable green power station!", Home page, Jan. 6, 2017, https://web.archive.org/web/20170106025932/https://bluetopsolar.com/ (Refer to Transmittal Letter of IDS for Concise Explanation of Relevancy. ).

(Continued)

*Primary Examiner* — Joshua K Ihezie
(74) *Attorney, Agent, or Firm* — Toshikatsu Imaizumi

(57) ABSTRACT

To provide a roof structure free from generation of a dead space, capable of reducing a load moment.
A roof structure including a roof (1) supported by a post (2) is a cantilever structure having the front end of the roof (1) formed in a free end and the rear end connected to the upper end of the post (2). The lower end of the post (2) is fixed in a concrete foundation (5). The post (2) is tilted with the upper end directed backward and with the lower end directed forward. A counter moment cm generated on the post (2) at the time of application of a load to the roof (1) reduces a load moment (M) generated by the load, thereby bringing the post (2) into an advantageous state in strength. The configuration of the post (2) with two post members and a vertical connecting member (10) connecting the post members facilitates the construction of the post (2) to be tilted at a desired angle.

6 Claims, 12 Drawing Sheets

(56) References Cited

U.S. PATENT DOCUMENTS

| | | | | |
|---|---|---|---|---|
| 2012/0124922 | A1* | 5/2012 | Cusson | F24S 25/634 52/173.3 |
| 2012/0216466 | A1* | 8/2012 | Powers, III | F24S 25/12 52/173.3 |
| 2012/0304552 | A1* | 12/2012 | Cox | H02S 20/22 52/73 |
| 2013/0118099 | A1* | 5/2013 | Scanlon | H02S 20/22 52/173.3 |
| 2014/0196387 | A1* | 7/2014 | Neito | H02S 20/10 52/173.3 |
| 2016/0190974 | A1* | 6/2016 | Dickey | H02S 20/10 136/244 |
| 2016/0340926 | A1* | 11/2016 | Barbret | E04H 15/28 |
| 2017/0159306 | A1 | 6/2017 | Maurus | |

FOREIGN PATENT DOCUMENTS

| | | | |
|---|---|---|---|
| JP | S44-5067 | Y1 | 2/1969 |
| JP | S51-020425 | A | 2/1976 |
| JP | S59-44443 | A | 3/1984 |
| JP | 2002-188243 | A | 7/2002 |
| JP | 2003-64897 | A | 3/2003 |
| JP | 3182617 | U | 4/2013 |
| JP | D1472298 | S | 6/2013 |
| JP | 2015-151778 | A | 8/2015 |
| WO | 2012/027666 | A2 | 3/2012 |
| WO | 2016/026513 | A1 | 2/2016 |
| WO | 2016/118988 | A1 | 8/2016 |

OTHER PUBLICATIONS

European Patent Office, Partial Supplemental European Search Report for European Patent Application No. 18850072.2, dated Apr. 24, 2021.

European Patent Office, Extended European Search Report for European Patent Application No. 18850072.2, dated Sep. 6, 2021.

* cited by examiner

ROOF STRUCTURE AND CONSTRUCTION METHOD THEREOF

TECHNICAL FIELD

The present invention relates to a roof structure and a construction method thereof. More specifically, the present invention relates to a roof structure having a basic structure having a roof supported by a post, including a garage (a carport), a bicycle parking lot (a cycle port) for storing bicycles, a corridor installed in a people walking site and the like, and a construction method of the roof structure.

BACKGROUND ART

Patent Literature 1 discloses a prior art as a conventional example of the roof structure represented by a carport. In this prior art, a roof is supported at the rear end thereof by a plurality of posts in a cantilever manner like many carports. The posts are set up vertically to the ground level, and the upper ends of the posts are fixed to the rear end of the roof and the lower ends are fixed in a concrete foundation buried in the ground.

The above prior art has the following problems.

As the first problem, a large load moment is applied to the vertical posts. The description below is based on FIG. 4 (B).

In the case where a large load W is generated on a roof 101 by accumulated snow or the like, a counterclockwise load moment M acts on a post 102. For this reason, the post 102 must be rigid enough to withstand the load moment M, and in addition the connection part between the post 102 and the roof 101 must be strengthened.

As the second problem in the above-described prior art, a dead space is formed behind the carport in many cases, when the carport is installed at a boundary with an adjacent land close to a fence or the like. The description below is based on FIG. 5 (B).

In the figure, reference numeral 150 denotes a block fence, and reference numeral 151 denotes an L-shaped footing serving as the foundation of the block fence.

A lower end 102*b* of the post 102 is buried and fixed in a concrete foundation 105. According to Japanese Ministry of Land, Infrastructure, Transport and Tourism, Notification No. 410 in 2002, the concrete foundation 105 must have a covering dimension e, which is identical to a width dimension d of the post itself, from the buried post 102 in order to secure the strength. Even if the concrete foundation 105 is brought closest to the L-shaped footing 151 while the covering dimension e is secured, a dead space Ds is formed between the rear end of the carport roof 101 and the block fence 150. That is, since the space serving as a carport to protect a car is up to just under the roof 101, the dead space Ds corresponds to a useless area beyond the protection by the carport. As described above, the above-described prior art restricts the effective use of the site.

As a well-known technical idea against the above-described problem in strength, high-strength design is considered, in such a manner that members included in the roof and the post are designed to have larger dimensions in cross section, or that stronger members (steel members or the like instead of aluminum members) are selected.

Such conventionally-known high-strength design not only increases the cost, but also increases the size and weight of a product, resulting in generation of new problems such as being restricted in selection of an installation place.

Patent Literature 2 and 3 also disclose prior arts as conventional examples of the roof structure represented by a carport. In these prior arts, a roof is supported at the middle thereof in the front-back direction by a plurality of tilted posts.

In the case where the posts are set up vertically, the verticality thereof is easily confirmed, and thus the roof structure is easily constructed at an accurate reference angle against the ground level. In the case where the posts are tilted, it is difficult to confirm whether or not the posts are tilted at a desired reference angle against the ground level. Therefore, such a problem arises, that it is difficult to accurately construct the posts and the roof of the roof structure at a desired reference angle against the ground level.

CITATION LIST

Patent Literature

[Patent Literature 1] Japanese Patent Application Laid-Open No. H6-88443

[Patent Literature 2] Utility Model Registration Gazette No. 3198635

[Patent Literature 3] Utility Model Registration Gazette No. 3182617

SUMMARY OF INVENTION

Technical Problem

Therefore, the present inventors have tried to solve, on the basis of a fundamentally-different design concept, the problems in the prior art with respect to the generation of a large load moment and the formation of a dead space, and the problems with respect to the increase in size and the increase in cost caused by the conventional high strength design.

In other words, the purpose of the present invention is to provide a roof structure having a cantilever structure in which the above-described problems are solved, on the basis of a completely new design concept in which a post is tilted.

Taking into consideration such situations, the purpose of the present invention is to provide a roof structure which includes a tilted post and which is easily constructed at an appropriate angle, and the construction method thereof.

Solution to Problem

The roof structure of a $1^{st}$ invention comprises a roof supported by a post. The roof structure is a cantilever structure having a front end of the roof formed in a free end and a rear end connected to an upper end of the post. A lower end of the post is fixed in the ground. The post is tilted with the upper end directed backward and with the lower end directed forward.

In short, the technical concept in the present invention is to achieve a roof structure having an advantage in strength, by tilting a post in a cantilever type roof structure, on the basis of a conception nobody has had.

The roof structure of a $2^{nd}$ invention is a roof structure wherein in the $1^{st}$ invention, a tilting angle of the post is 65 to 85 degrees.

The roof structure of a $3^{rd}$ invention is a roof structure wherein in the $1^{st}$ invention or the $2^{nd}$ invention, the lower end of the post is fixed in a concrete foundation in the ground, and a rear end of the concrete foundation is positioned in front of the rear end of the roof.

The roof structure of a $4^{th}$ invention is a roof structure wherein in the $1^{st}$ invention, the $2^{nd}$ invention or the $3^{rd}$ invention, the post is an assembly of two post members arranged in parallel.

The roof structure of a $5^{th}$ invention is a roof structure wherein in the $4^{th}$ invention, the post includes a vertical connecting member connecting the two post members, and the vertical connecting member is installed vertically to the ground level.

The roof structure of a $6^{th}$ invention is a roof structure wherein in the $4^{th}$ invention or the $5^{th}$ invention, the two post members are connected to each other at the lower ends thereof by a lower end connecting member having an L-shape in cross section.

The construction method of the roof structure of a $7^{th}$ invention is a construction method of the roof structure described in the $5^{th}$ invention, wherein the construction method comprises the step of fixing the post in the ground, while keeping the vertical connecting member vertical to the ground level.

The roof structure of an $8^{th}$ invention comprises a roof supported by a post. The post is tilted, and includes two post members and a vertical connecting member connecting the post members. The vertical connecting member is installed vertically to the ground level.

The roof structure of a $9^{th}$ invention is a roof structure wherein in the $8^{th}$ invention, the two post members are connected to each other at the lower ends thereof by a lower end connecting member having an L-shape in cross section.

The construction method of the roof structure of a $10^{th}$ invention is a construction method of the roof structure described in the $8^{th}$ invention, wherein the construction method comprises the step of fixing the post in the ground, while keeping the vertical connecting member vertical to the ground level.

Advantageous Effects of Invention

According to the $1^{st}$ invention, since the post is tilted so that the upper end of the post is positioned backward and the lower end is directed (positioned) forward, a counter moment is generated on the post when a load is applied to the roof. The counter moment offsets (reduces) the load moment generated by the load, thereby enabling to bring the post into an advantageous state in strength. Accordingly, a lightweight member such as an aluminum shape is available as a member to be used, and the roof structure is able to be configured without enlargement in size. Therefore, the cost does not increase, nor is the installation place restricted in selection.

Since the post is connected to the rear end of the roof, the post does not hinder the access to a parked car or the passage of people.

According to the $2^{nd}$ invention, since the tilting angle of the post is 65 to 85 degrees, the reduction effect to the load moment by the counter moment is secured sufficiently, and a problem such as the reduction in allowable stress of the post is not generated.

According to the $3^{rd}$ invention, the rear end of the roof is able to be installed close to the boundary with an adjacent land such as a fence, while the covering dimension of the concrete foundation is secured. The roof structure is thus able to be installed so as not to form a dead space.

According to the $4^{th}$ invention, since the width dimension of the post is able to be changed by changing the distance between the two post members, the strength of the post is adjustable. Therefore, since the width dimension of the post is able to be enlarged without enlargement in size of a member, the post is able to be strengthened. A cover or an accessory (a lighting device, a guide plate, etc.) is able to be attached between the two post members, and thereby the design thereof is able to be improved and the functionality thereof is able to be provided.

According to the $5^{th}$ invention, the vertical connecting member is installed vertically to the ground level, thereby enabling to tilt the post accurately at a desired angle against the ground level. This facilitates the construction of the roof structure in which the post is tilted. The vertical connecting member connects the two post members, thereby enhancing the rigidity of the post.

According to the $6^{th}$ invention, the lower end connecting member having an L-shape in cross section is used, so that the lower end connecting member functions as a leg when the post is set up in the foundation, and the post is thus able to be set up stably when installed temporarily. As a result, the construction of the roof structure is facilitated.

According to the $7^{th}$ invention, the vertical connecting member is installed so as to keep the state of indicating verticality to the ground level, thereby facilitating the construction of the post tilted accurately at a desired angle against the ground level. This facilitates the construction of the roof structure in which the post is tilted.

According to the $8^{th}$ invention, the vertical connecting member is installed vertically to the ground level, thereby enabling to tilt the post accurately at a desired angle against the ground level. This facilitates the construction of the roof structure in which the post is tilted. The vertical connecting member connects the two post members, thereby enhancing the rigidity of the post.

According to the $9^{th}$ invention, the lower end connecting member having an L-shape in cross section is used, so that the lower end connecting member functions as a leg when the post is set up in the foundation, and the post is thus able to be set up stably when installed temporarily. As a result, the construction of the roof structure is facilitated.

According to the $10^{th}$ invention, the vertical connecting member is installed so as to keep the state of indicating verticality to the ground level, thereby facilitating the construction of the post tilted accurately at a desired angle against the ground level. This facilitates the construction of the roof structure in which the post is tilted.

DESCRIPTION OF EMBODIMENTS

Embodiments of $1^{st}$ to $4^{th}$ Inventions

The application targets of the roof structure according to the $1^{st}$ to $4^{th}$ inventions include a cycle port and a corridor, in addition to a carport. An embodiment of a carport, which is a representative application target, is described below on the basis of FIG. 1 to 3.

Figure 1:
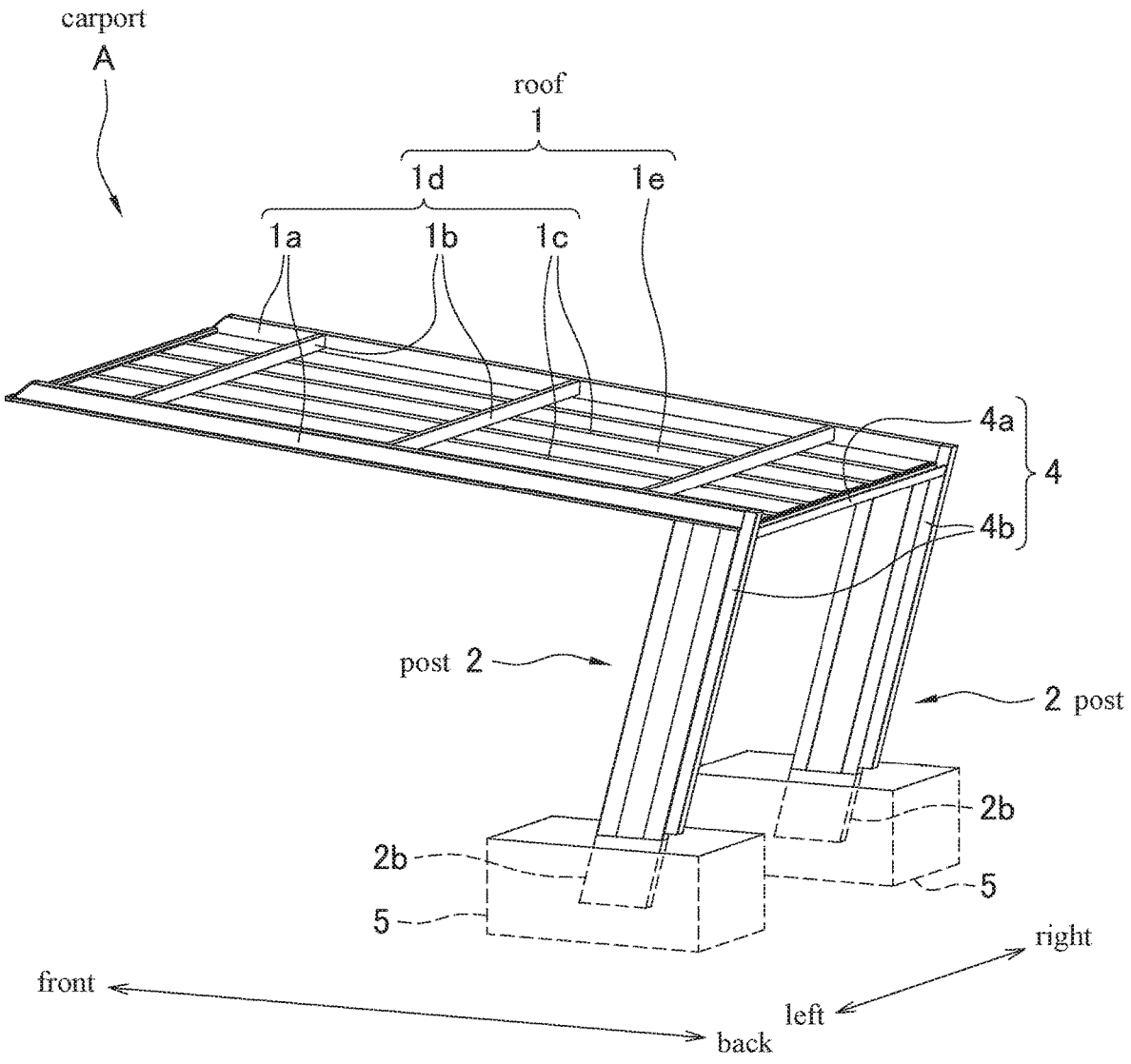
FIG. 1 is a perspective view of a roof structure (carport A) according to an embodiment of a $1^{st}$ to $4^{th}$ invention, as viewed obliquely from above.
Figure 2:
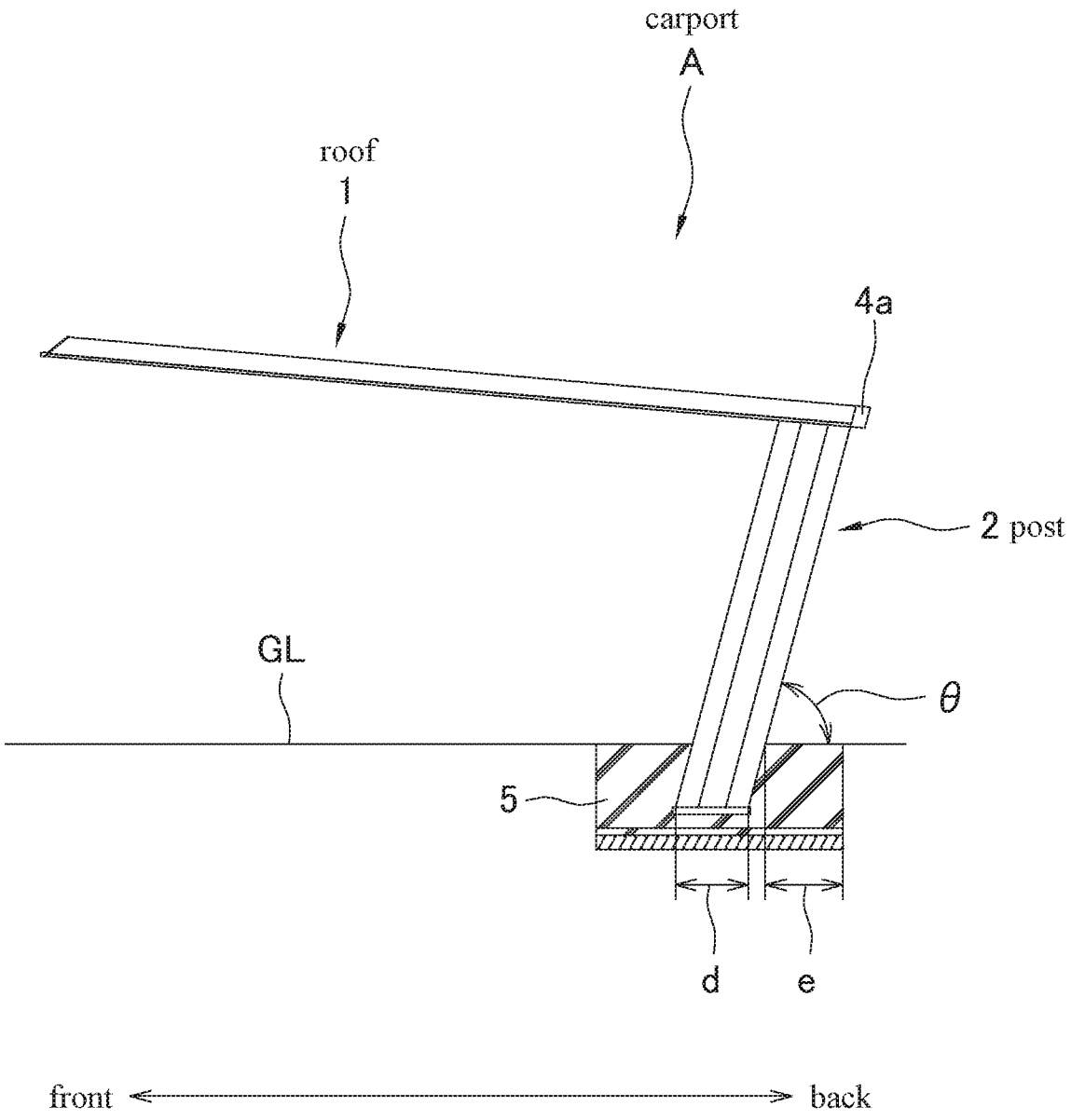
FIG. 2 is a side view of the roof structure (carport A) shown in FIG. 1.

It is noted that, in the present specification, the term meaning a front-back direction is expressed as "forward" or "front end" on the basis of the left side in FIGS. 1 and 2, or expressed as "backward" or "rear end" on the basis of the right side. The term meaning right and left is expressed on the basis of the right and the left in FIGS. 1 and 3. The term meaning up and down is expressed on the basis of the up-down direction in the figures. Reference sign GL in FIGS. 2 and 3 denotes the ground level.

Reference sign A denotes a carport, including a roof 1 and a post 2 as components.

The roof 1 is attached and fixed to a pair of the right and left posts 2, 2 at the rear end of the roof 1. The front end of the roof 1 is a free end. That is, the roof structure according to the present invention is a cantilever structure.

The roof 1 is a well-known member, in which a flat roof member 1*e* is fixed to a frame member 1*d* including a beam 1*a*, a purlin 1*b* and a rafter 1*c*. It is noted that the present invention includes any roof structure, even without the frame member 1*d* or the roof member 1*e* as shown in the figures, as long as the structure functions as a roof.

Aluminum extruded shapes are used as the beam a, the purlin 1*b* and the rafter 1*c*. The present invention is not limited thereto, however.

A member made of transparent synthetic resin such as polycarbonate is representatively used as the roof member 1*e*. The present invention is not limited thereto, however.

The posts 2, 2 are used in a pair in the right and left. Since they have the same configuration, one post 2 is treated as a representative, and the configuration thereof is described below.

An aluminum extruded shape is used as the post 2, which has the advantages of being lightweight and being excellent in weather resistance as compared with a steel member and the like.

In the present invention, the number of the posts 2 supporting the roof 1 may be two or more. The number is not limited. That is, in an example, a plurality of the posts 2 may be provided between the posts 2 formed in a pair in the right and left in the case of a roof in a large size in the right and left, as long as the posts 2 are fixed to the rear end of the roof 1 and are able to support the roof 1 in a cantilever manner.

Figure 4:
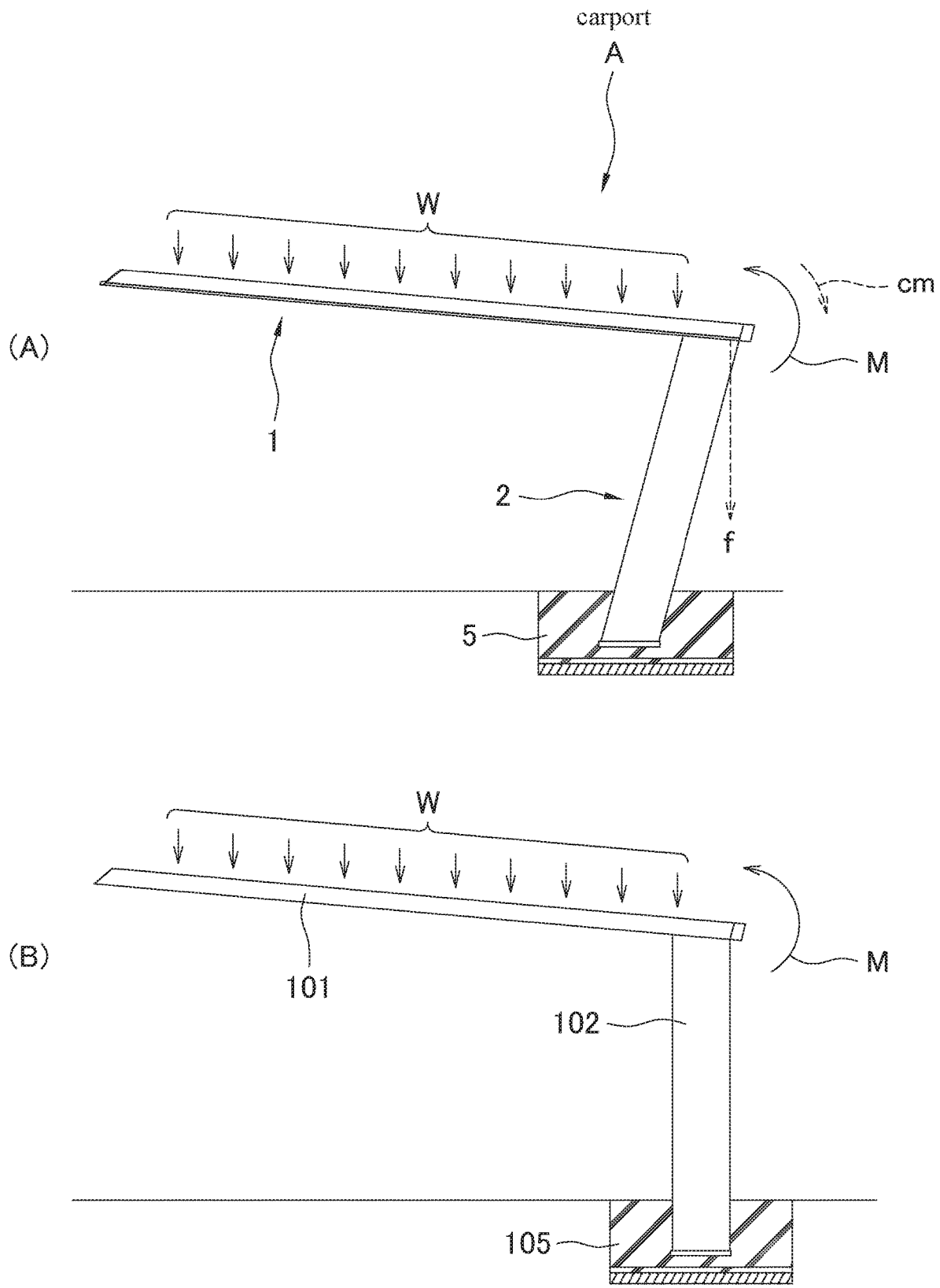
FIG. 4 is an explanatory view of a counter moment cm acted on the roof structure (carport), wherein FIG. 4 (A) shows an example of the present invention and FIG. 4 (B) shows an example of the prior art.
Figure 5:
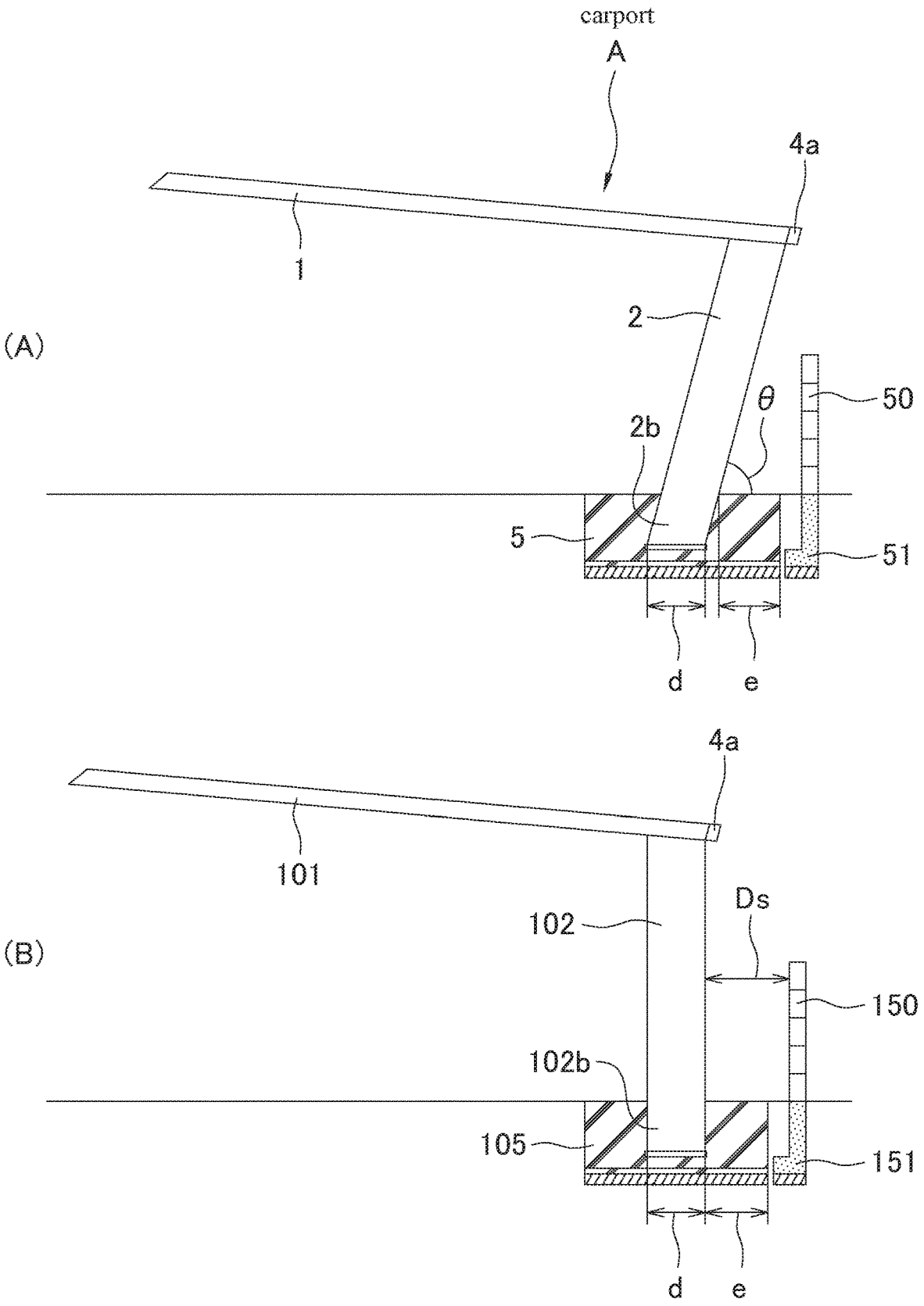
FIG. 5 is an explanatory view of a dead space Ds in the roof structure (carport), wherein FIG. 5 (A) shows an example of the present invention and FIG. 5 (B) shows an example of the prior art.
Figure 6:
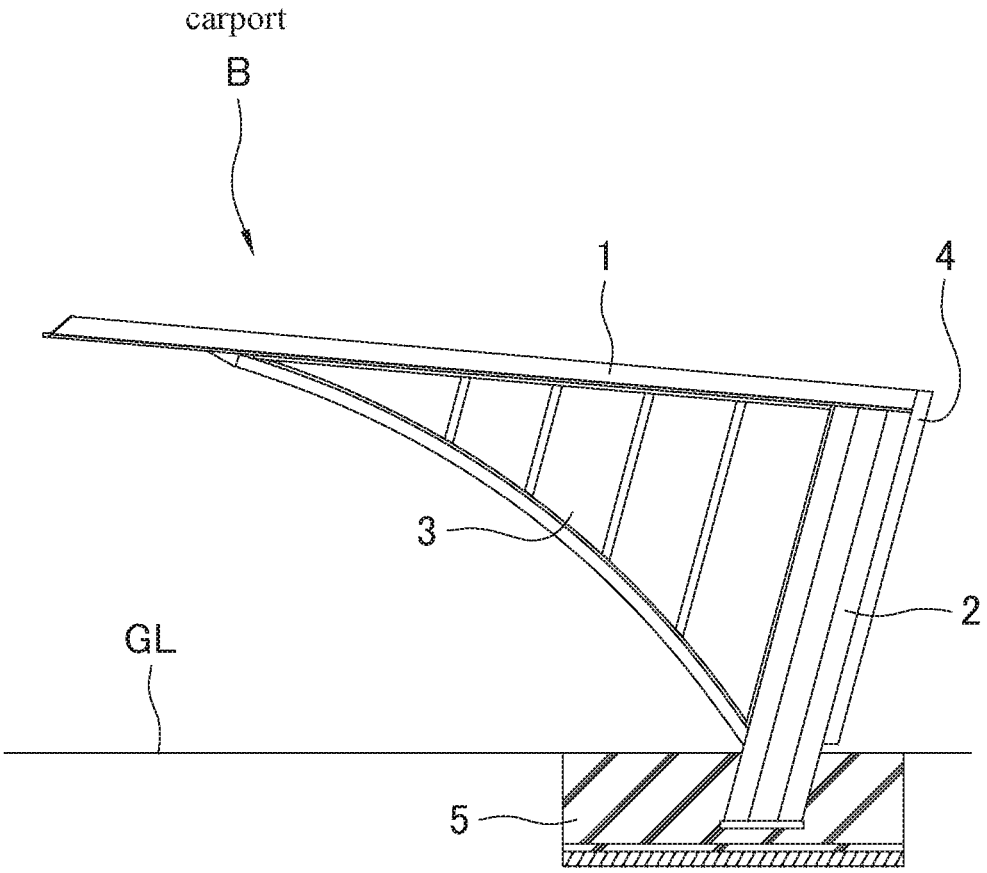
FIG. 6 is a side view of a roof structure (carport B) according to another embodiment of the $1^{st}$ to $4^{th}$ inventions.

A well-known post structure may be adopted for the post 2. The post 2 may be configured with one post member, or may be configured with two post members. In the case of the configuration with two post members according to the $4^{th}$ invention, a configuration may be adopted in which two post members in parallel are connected by a plurality of connecting members and a cover is attached between the post members. The post having such a configuration has an advantage that the width of the post 2 is increased in an easy manner, without using a larger-sized member. Even in the case where the post 2 is configured with two post members, the present invention includes various types of configuration such as the post 2 configured without a connecting member or a cover. It is noted that each of FIGS. 1, 2 and 6 shows the post 2 with a cover attached, and each of FIGS. 4 and 5 shows only the appearance of the post 2 without showing a cover, for simplification.

The upper ends of the posts 2, 2 and the rear end of the roof 1 may be connected arbitrarily by known means. That is, a known method is used representatively, such as the method in which an L-shaped insertion fitting is inserted into the hollow portion of the beam 1*a* and the hollow portion of the post 2, and is fixed with a bolt. Any other connection method may be adopted. The present invention further includes, for example, the connection of the lower end surface of the beam 1*a* to the upper end surface of the post 2, and the connection of the upper end surface of the post 2 and the upper end surface of the beam 1*a* to be substantially flush with each other.

A lower end 2*b* of the post 2 is fixed in a concrete foundation 5 in the ground.

A gutter 4 is attached to the rear end of the roof 1 and the rear surface of the post 2. The gutter 4 includes a horizontal gutter 4*a* to be attached to the rear end of the roof 1 and a vertical gutter 4*b* to be attached to the rear surface of the post 2. It is noted that each of FIGS. 1 and 6 shows the entire gutter 4, while each of FIGS. 2, 4 and 5 shows only the horizontal gutter 4*a*, for simplification.

As shown in FIG. 2, the present invention is characterized in that the post 2 is tilted against the ground level GL.

The post 2 is tilted in such a manner that the upper end of the post 2 is positioned backward, and the lower end of the post 2 is positioned forward. The rear end of the concrete foundation 5 is positioned in front of the rear end of the roof 1. In the present specification, such tilting may be referred to as "backward tilting."

The $1^{st}$ effect produced by the backward tilting of the post 2 is described on the basis of FIG. 4 (A).

A large downward load W is assumed to be generated on the roof 1 by accumulated snow or the like. In this case, a counterclockwise load moment M is generated around the upper end of the post 2. There is no difference from the prior art, so far.

The load W applied to the roof 1 also generates a force f which presses the post 2 downward. The pressing-down force f corresponds to the pressing-down force vertically downward from the upper end of the post 2. In the present invention, since the lower end of the post 2 is positioned forward, the pressing-down force f generates a moment to rotate the post 2 clockwise. This moment is referred to as a counter moment cm in the present specification, and is expressed by a dotted line in the figure. The counter moment cm acts in the direction opposite to that of the load moment M, thereby acting to reduce the load moment M.

From the viewpoint of effective production of the reduction effect to the load moment M, a tilting angle θ of the post 2 against the ground level GL is preferably 65 to 85 degrees.

In the case where the tilting angle exceeds 85 degrees, the reduction effect to the load moment M by the counter moment cm decreases. In the case where the tilting angle is lower than 65 degrees, disadvantages increase, such as reduction in allowable stress of the post 2, increase in cost due to a longer post itself, and inconvenience in accessing to a vehicle.

In the case where the tilting angle falls within the range between 65 degrees and 85 degrees, the above-described disadvantages are practically negligible, and the reduction effect to the load moment M is able to be obtained.

The tilting angle is more preferably in the range between 70 degrees and 80 degrees, and most preferably 75 degrees. The smaller the tilting angle θ becomes, the larger the counter moment cm becomes, and accordingly the reduction effect to the load moment M increases. In the case where the tilting angle falls within the range between 70 degrees and 80 degrees, the reduction effect to the load moment M and the strength retention of the post 2 are balanced properly, and thus such a tilting angle is highly practical.

In the case where the tilting angle is 75 degrees, the reduction effect to the load moment M approximately corresponds to 25%. That is, the load moment M decreases from 100% to 75%.

As described above, the present invention enables to bring the post 2 into an advantageous state in strength by tilting the post 2 backward. In other words, the present invention enables to improve the moment-resistance strength of the post 2 by 25% against the load moment M. Therefore, the post 2 having the same size in cross section as that of the post installed vertically is capable of withstanding a larger load (load W) than the post installed vertically. Moreover, even the post 2 having a smaller size in cross section than that of the post installed vertically is capable of supporting the equivalent load (load W).

The above description relates to the load W generated by accumulated snow or the like. The same effect is also produced by an external force to lift the roof 1 upward. In an example, when a strong wind blows from the front to the rear, the roof 1 receives a force to lift the roof 1 upward, and at the same time a clockwise load moment is generated at the upper end of the post 2. The direction of this load moment is opposite to the load moment M shown in FIG. 4. A counter moment is also generated in the opposite direction to the counter moment cm shown in FIG. 4. Accordingly, the load moment is offset and reduced likewise.

As described above, the present invention enables to bring the post 2 into an advantageous state in strength also against a strong wind.

As described above, the post 2 according to the present invention is tilted backward in order to generate the counter moment cm. Thereby, the roof 1 is able to be supported only by the post 2 tilted backward.

The second effect produced by the backward tilting of the post 2 is described below on the basis of FIG. 5 (A).

In the figure, reference numeral 50 denotes a block fence, and reference numeral 51 denotes an L-shaped footing which is the foundation of the block fence 50.

In the present invention also, the lower end 2*b* of the post 2 is buried and fixed in the concrete foundation 5. For securing strength, this concrete foundation 5 has a covering dimension e from the post 2, which is identical to a width dimension d of the post 2, as in the prior art (Note: Japanese Ministry of Land, Infrastructure, Transport and Tourism, Notification No. 410 in 2002).

In the case where the concrete foundation 5 having the covering dimension e is installed close to the L-shaped footing 51, the rear end of the roof 1 is able to be easily positioned closest to the fence or the like because of the backward tilting of the post 2. In other words, the installation position of the concrete foundation 5 is able to be selected without being restricted by the installation position of the L-shaped footing 51.

Accordingly, depending on the numerical value of the tilting angle θ, the rear end of the roof 1 is able to be brought closer to the block fence 50 as much as possible. In this case, the space just under the roof 1 protected by the roof 1 spreads up to the immediate front of the block fence 50, and thus there is no dead space not protected by the roof 1.

As described above, the carport A according to the present embodiment allows the site to be used effectively.

FIG. 6 shows a carport B according to another embodiment in the $1^{st}$ to $4^{th}$ inventions.

Figure 3:
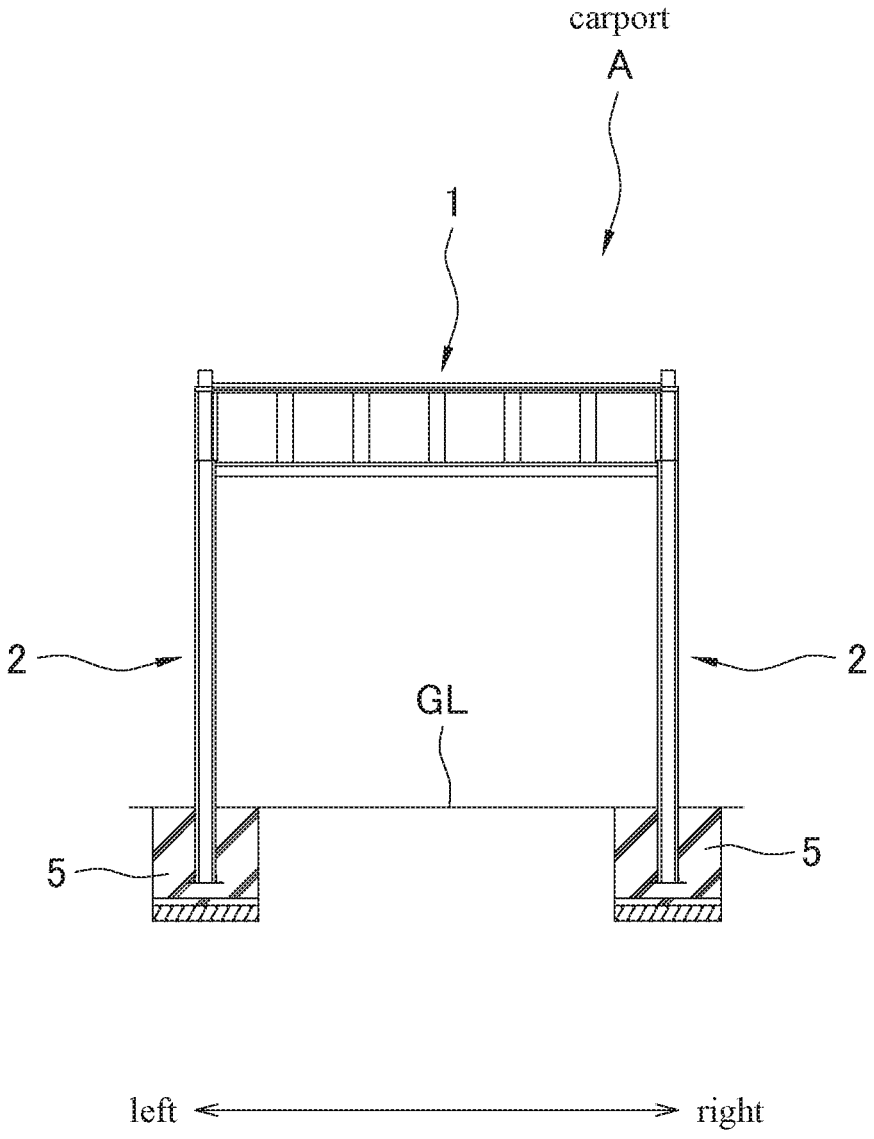
FIG. 3 is a front view of the roof structure (carport A) shown in FIG. 1.

The basic configuration, which includes the roof 1 and the pair of posts 2, 2 and in which the posts 2 are tilted backward, is the same as the configuration according to the embodiment described on the basis of FIG. 1 to 3.

In the present embodiment, a side panel 3 is attached to the space between the roof 1 and the post 2. In an example configuration of the side panel 3, a transparent synthetic resin plate such as of polycarbonate is attached to a frame made of aluminum. The present invention is not limited thereto.

In the roof structure of each of the above-described embodiments, various accessories such as a lighting device (for example, an LED device) and a guide plate (a sign) may be attached.

Although each of the illustrated carports A, B is a carport for parking of one vehicle, the present invention is applicable also to a carport for parking of a plurality of vehicles such as two or more vehicles. In the case where the present invention is applied to a carport for parking of a plurality of vehicles, the number of the posts 2 may be increased, or the carports connected in a row may be used.

In the carports A, B according to the above-described embodiments, the load moment M is able to be offset by the counter moment cm generated due to the backward tilting of the post 2. Each of the carports A, B produces the mutually contrary effects that the post 2 is able to be brought into an advantageous state in strength without the use of a member having a larger size or material excellent in strength, that is, without the increase in cost. In addition, each of the carports A, B has such an advantage that the ease in accessing to a parked vehicle can also be secured.

Embodiments of $5^{th}$ and $6^{th}$ Inventions

The application targets of the roof structure according to the $5^{th}$ and $6^{th}$ inventions include a cycle port, a corridor and the like, in addition to a carport. An embodiment of a carport, which is a representative application target, is described below.

Figure 7:
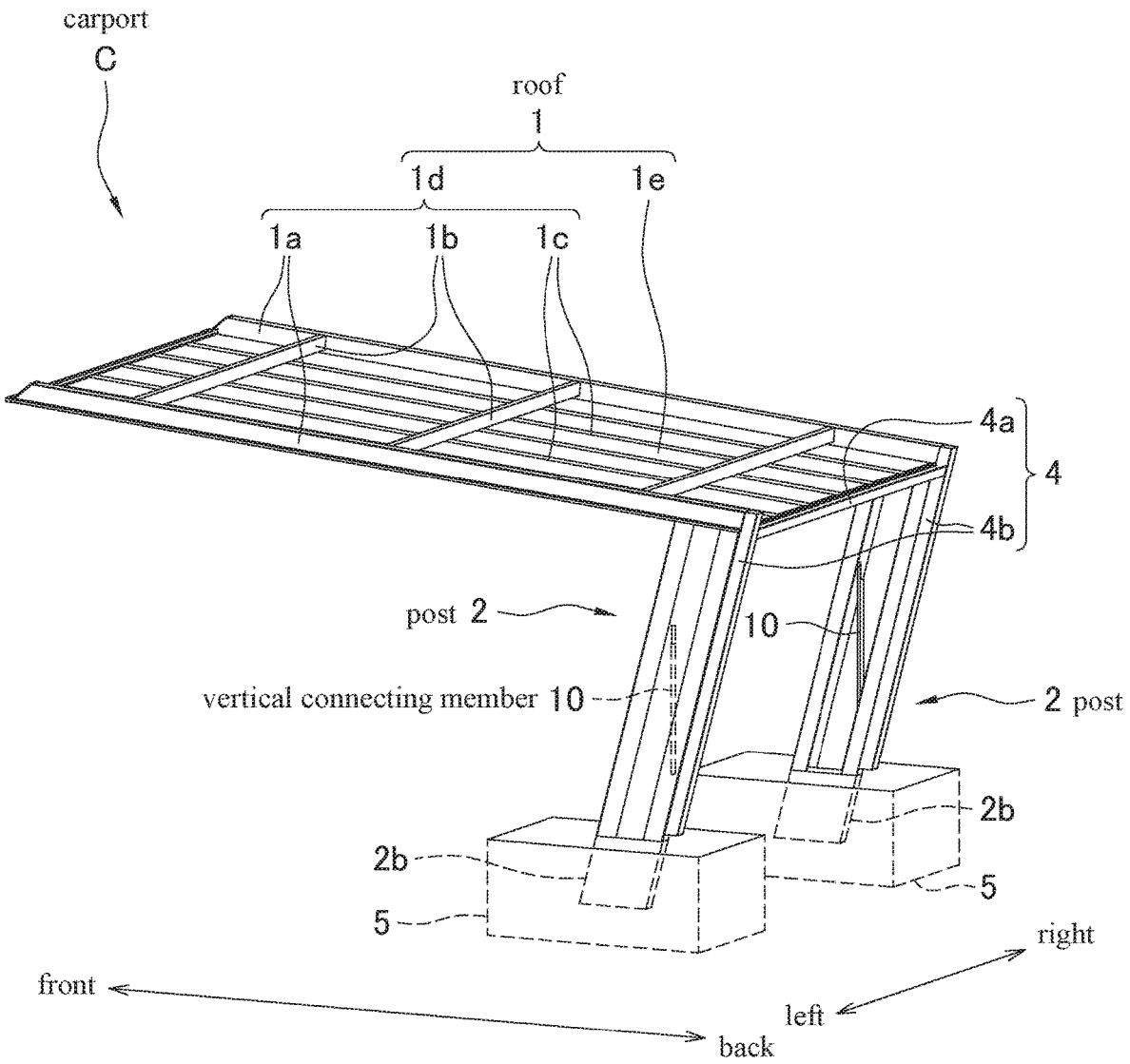
FIG. 7 is a perspective view of a roof structure (carport C) according to an embodiment of a $5^{th}$ invention and a $6^{th}$ invention, as viewed obliquely from above.
Figure 8:
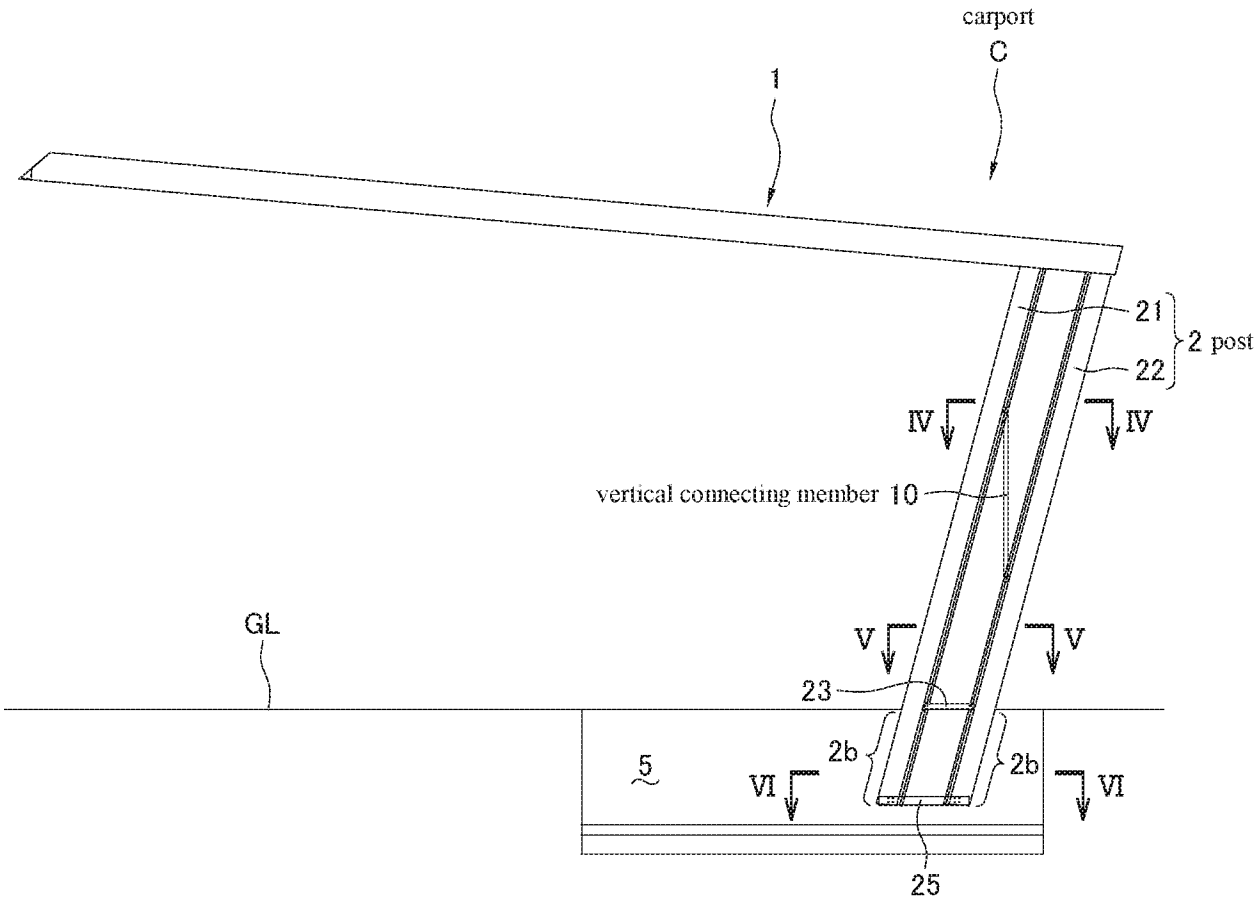
FIG. 8 is a side view of the roof structure (carport C) shown in FIG. 7.

It is noted that, in the present specification, the term meaning a front-back direction is expressed as "forward" or "front end" on the basis of the left side in FIGS. 7 and 8, or expressed as "backward" or "rear end" on the basis of the right side. The term meaning up and down is expressed on the basis of the up-down direction in the figures. Reference sign GL in FIG. 8 denotes the ground level.

(Configuration of Roof Structure)

Reference sign C shown in FIGS. 7 and 8 denotes a carport, including a roof 1 and a post 2 as major components.

The roof 1 is attached and fixed to a pair of the right and left posts 2, 2 at the rear end of the roof 1. The front end of the roof 1 is a free end.

It is noted that, in the present invention, the number of the posts 2 supporting the roof 1 may be two or more. The number is not limited. In an example, in the case of a roof in a large size in the right and left, a plurality of the posts 2 may be provided between the pair of the right and left posts 2.

The roof 1 is a well-known member, in which a flat roof member 1*e* is fixed to a frame member 1*d* including a beam 1*a*, a purlin 1*b* and a rafter 1*c*. It is noted that the present invention includes any roof structure, even without the frame member 1*d* or the roof member 1*e* as shown in the figures, as long as the roof structure functions as a roof.

In the present invention, aluminum extruded shapes are used as the beam 1*a*, the purlin 1*b* and the rafter 1*c*. The present invention is not limited thereto, and any type of material is available.

In the present invention, a member made of transparent synthetic resin such as polycarbonate is representatively used as the roof member 1*e*. The present invention is not limited thereto, and any type of material is available.

The posts 2, 2 are used in a pair in the right and left, and have the same configuration. Therefore, one post 2 is treated as a representative, and the configuration thereof is described below.

The upper ends of the posts 2, 2 and the rear end of the roof 1 may be connected arbitrarily by known means. That is, a known method is used representatively, such as the method in which an L-shaped insertion fitting is inserted into the hollow portion of the beam 1*a* and the hollow portion of the post 2, and is fixed with a bolt. Any other connection method may be adopted. The present invention further includes, for example, the connection of the lower end surface of the beam 1*a* to the upper end surface of the post 2, and the connection of the upper end surface of the post 2 and the upper end surface of the beam 1*a* to be substantially flush with each other.

A lower end 2*b* of the post 2 is fixed in a concrete foundation 5 in the ground.

A gutter 4 is attached to the rear end of the roof 1 and the rear surface of the post 2. The gutter 4 includes a horizontal gutter 4*a* to be attached to the rear end of the roof 1 and a vertical gutter 4*b* to be attached to the rear surface of the post 2. The gutter 4 different from that shown in the figure may be used. The present invention includes the configuration without the gutter 4.

As shown in FIGS. 7 and 8, the present invention is characterized in that the post 2 is tilted, and in the roof structure a post member 21 and a post member 22 which are two components of the post 2 are connected by a vertical connecting member 10.

In the present embodiment, the post 2 is tilted in such a manner that the upper end of the post 2 is positioned backward, and that the lower end of the post 2 is positioned forward. In the present specification, such tilting may be referred to as "backward tilting." The rear end of the concrete foundation 5 is positioned in front of the rear end of the roof 1.

The vertical connecting member 10 is the member to be disposed so as to indicate verticality to the ground level GL in the case where the post 2 is tilted properly at a desired angle.

(Structure of Post)

Figure 9:
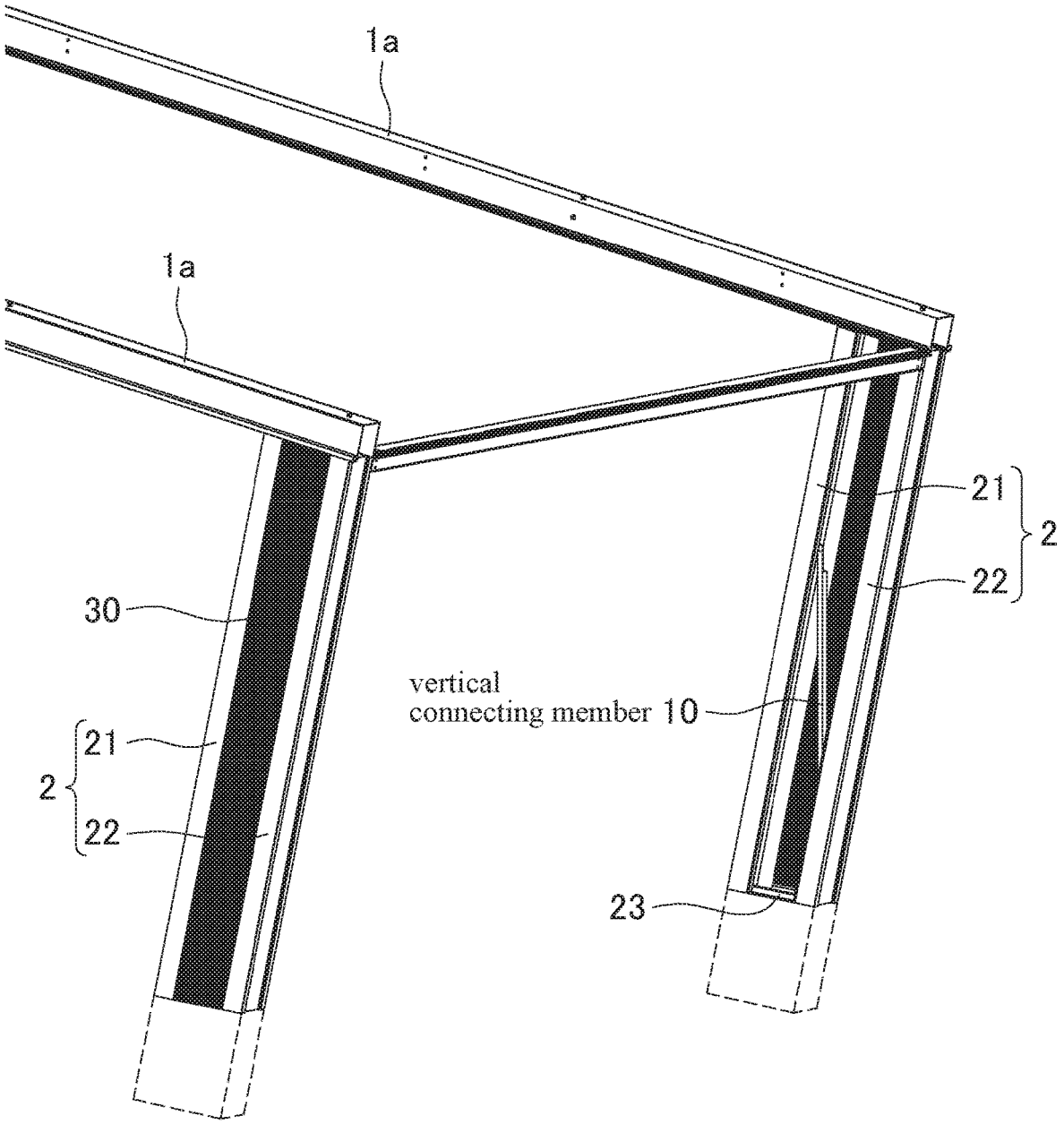
FIG. 9 is an enlarged perspective view of a vertical connecting member 10 and a post 2 shown in FIG. 8.

As shown in FIGS. 8 and 9, the post 2 has such a configuration that two members of the post members 21, 22 are arranged in parallel and connected by the vertical connecting member 10 so as to be assembled into one post. Each of the post members 21, 22 is an aluminum extruded shape, and has the advantages of being lightweight and being excellent in weather resistance as compared with a steel member and the like. Each of the post members 21, 22 has a substantially rectangular shape in cross section.

The post 2 according to the present embodiment includes the two post members 21, 22 as strength members. A cover is attached to these in general for making the appearance beautiful. FIG. 8 shows the post 2 not having any cover. FIG. 9 shows the post 2 not having any cover on the inside (the sides where the posts 2 face each other) and having a cover on the outside.

The upper ends of the post members 21, 22 are connected to the beam 1*a* of the roof 1 as described above. The post members 21, 22 are connected by a lower end connecting member 25 at the lower ends thereof, and are connected by a ground level connecting member 23 at the portions slightly above the lower ends (the positions corresponding to the ground level GL when installed).

The two post members 21, 22 are connected in this manner, thereby being integrally fixed while maintaining a parallelogram shape which is long in the up-down direction.

(Vertical Connecting Member)

The vertical connecting member 10 may be any member as long as it can connect the two post members 21, 22. The present invention is not limited to particular material or a particular shape. Examples of the material include resin and metal such as steel and aluminum. A preferable shape has at least one vertical surface (a surface vertical to the ground level) in each of the front-back direction and the right-left direction. Examples of the shape include an L-shape, an angular U-shape, and a rectangular shape in cross section.

Figure 10:
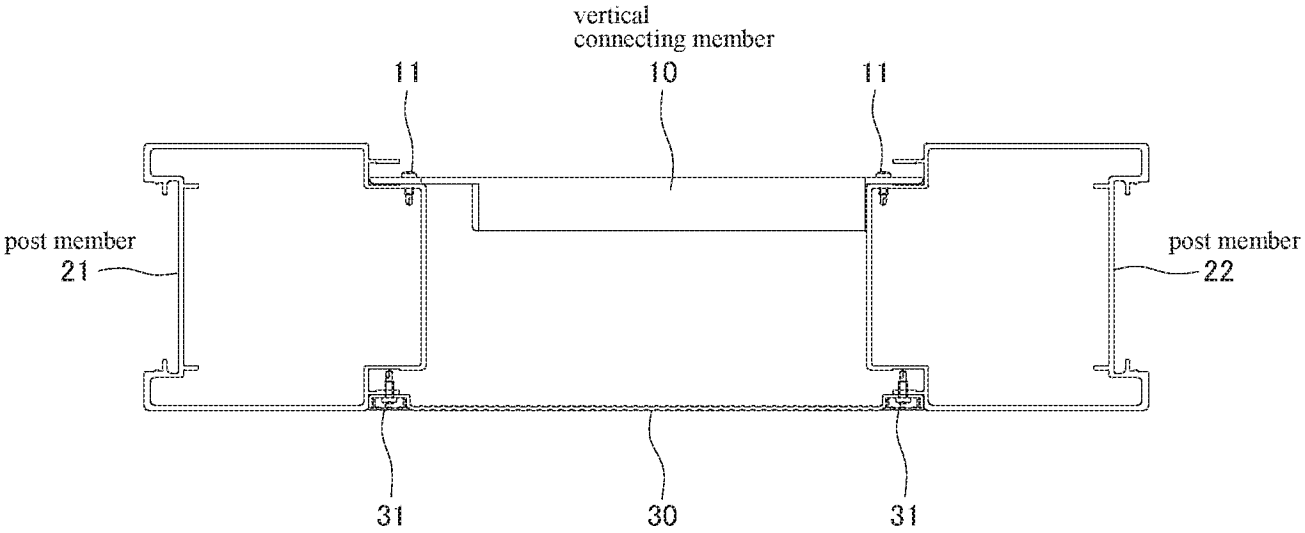
FIG. 10 is a cross-sectional view taken along a line IV-IV shown in FIG. 8.

In the present embodiment, as shown in FIGS. 9 and 10, the vertical connecting member 10 is a member configured with a steel angle member. The vertical connecting member 10 is attached to the post members 21, 22 with screws 11 at the both ends thereof. It is noted that FIG. 9 shows the state in which a cover 30 is attached to each of the outsides of the two posts 2, and any cover is not attached to each of the insides. FIG. 10 shows the state in which the cover 30 is attached to the right side of the post members 21, 22, and the state in which any cover is not attached to the left side (the side to which the vertical connecting member 10 is attached).

In FIGS. 8 and 9, the vertical connecting member 10 is installed vertically to the horizontal ground level GL (or right-angled to the horizontal ground level GL). This means that the vertical connecting member 10 is positioned vertically to the horizontal ground level GL in the cases where the post 2 is installed correctly at a desired angle against the ground level GL.

The term "vertical connecting member" as in the claims refers to the member having the functions of indicating verticality and further connecting two post members included in a post.

Accordingly, a level or the like which is a tool used at the time of construction is pressed against the vertical connecting member 10, and the verticality is confirmed by use of the display function of the level, whereby the post 2 is constructed to be tilted accurately and easily at a desired angle. The vertical connecting member 10 itself may have such a function of a level or the like. The present invention includes such a vertical connecting member 10.

Figure 11:
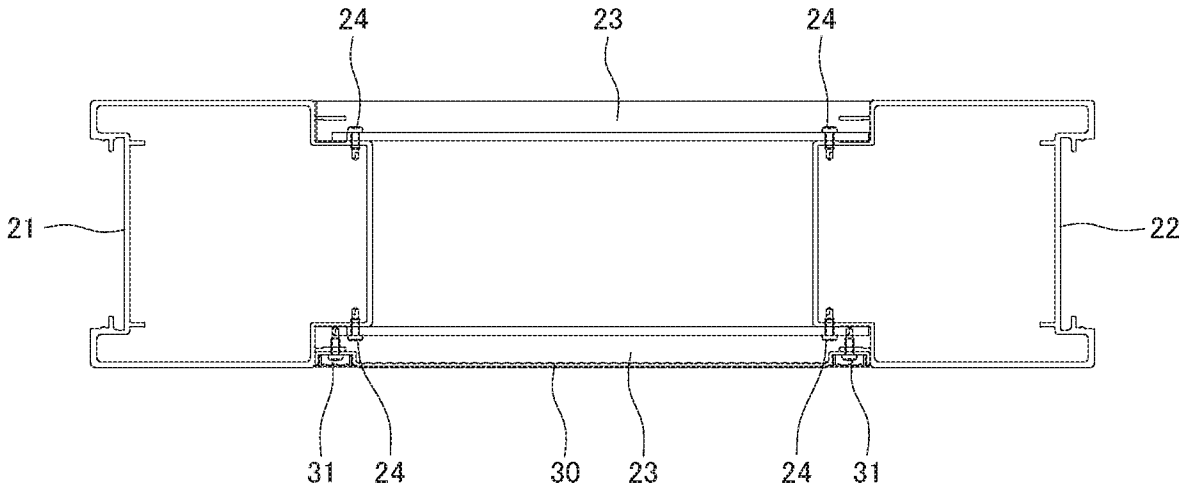
FIG. 11 is a cross-sectional view taken along a line V-V shown in FIG. 8.

As described above, the ground level connecting members 23, 23 shown in FIG. 11 are connected to the root portions of the two post members 21, 22, that is, at the positions corresponding to the ground level GL. The ground level connecting members 23, 23, which are well-known angle members, are attached to the inside and the outside of the two post members 21, 22 by screws 24, 24, respectively.

In FIG. 11, the left side is the inside of the post 2 (the post members 21, 22), and the right side is the outside of the post 2. The state in which the cover 30 is attached to the outside and any cover is not attached to the inside is shown.

Figure 12:
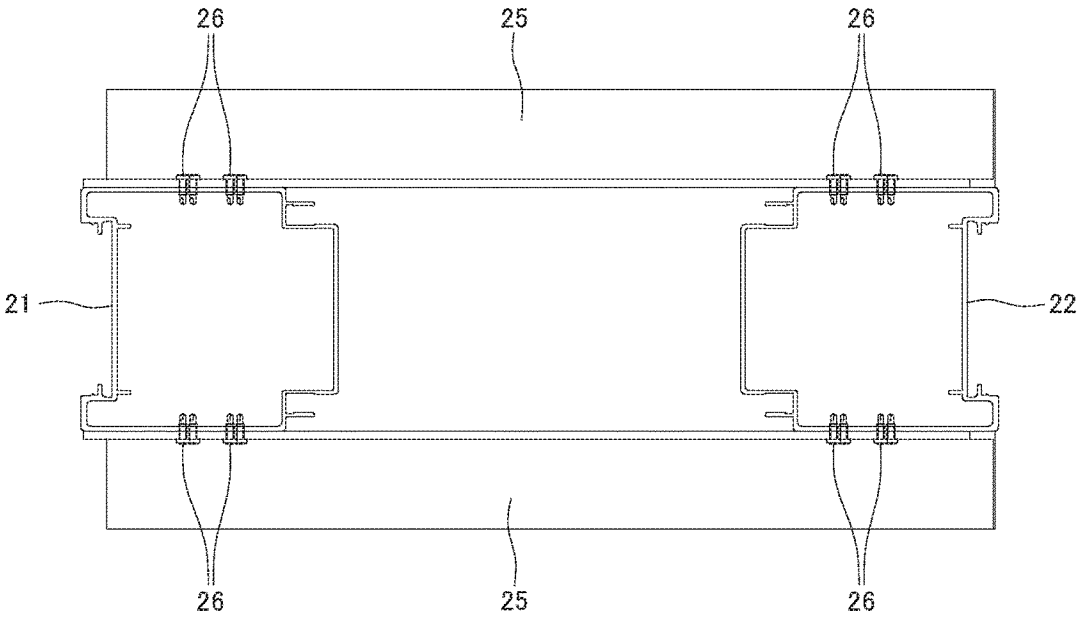
FIG. 12 is a cross-sectional view taken along a line VI-VI shown in FIG. 8.

The lower end connecting members 25, 25 shown in FIG. 12 are connected to the outside and the inside of the lower end of the post 2, that is, the two post members 21, 22. The lower end connecting members 25, 25, which are steel angle members, have widths larger than the widths of the ground level connecting members 23, 23. The lower end connecting members 25, 25 are attached to the outside and the inside of the two post members 21, 22 by screws 26, 26.

The lower end connecting member 25 and the ground level connecting member 23 are installed horizontally.

A member having an L-shape in cross section (angle member) is used as the lower end connecting member 25, whereby the area in contact with the installation surface increases. Accordingly, when the post 2 is set up in the foundation, the lower end connecting member 25 is able to function like as a leg. Thereby, the post 2 is able to be set up stably when temporarily installed, and thus easily constructed.

The use of the lower end connecting member 25 having an L-shape in cross section increases the area in contact with the installation surface, and thus enables to stably set up the post 2 at the time of temporary installation, even without the processing to make the lower ends of the post members 21, 22 in parallel to the installation surface.

Accordingly, the manufacturing cost (especially, processing cost) of the post members 21, 22 is able to be reduced. Furthermore, since the lower end connecting member 25 has an L-shape in cross section, the area in contact with the foundation is able to be increased in the horizontal direction, and thereby the force in the vertical direction generated in the post 2 is able to be efficiently transmitted to the foundation. Accordingly, the roof structure is able to be strengthened.

A steel member is used as the lower end connecting member 25, whereby the center of gravity in the post 2 is lowered. Accordingly, the post 2 is able to be set up stably when temporarily installed, and thus easily constructed.

In the post 2 according to the present embodiment, as shown in FIGS. 9 and 10, the vertical connecting member 10 fixes the two post members 21, 22 to restrain the separation in the vertical direction, and the ground level connecting member 23 and the lower end connecting member 25 restrain the separation of the two post members 21, 22 in the horizontal direction. Accordingly, the effect to enhance the rigidity of the post 2 is also produced.

Embodiment of $7^{th}$ Invention (Construction Method of Roof Structure)

The description below is based on FIGS. 7 and 8.

(1) Preparation of Post 2

In order to obtain the assembly of the post 2, the lower end connecting member 25, the ground level connecting member 23 and the vertical connecting member 10 are attached to the two post members 21, 22. The cover 30 is attached to the outside of the post 2, not attached to the inside.

The work so far may be performed in a factory before construction, or may be performed at a construction site.

The frame member 1*d* of the roof 1 is preferably attached prior to the work of setting up the post 2.

(2) Setting Up of Post

A foundation hole is dug at the installation position of the post 2, and concrete is poured therein. The post 2 is set up after curing. In this case, the post 2 is tilted at a desired angle. Whether or not the angle exactly corresponds to a desired value is able to be determined on the basis of determination of whether or not the vertical connecting member 10 indicates verticality by use of the level pressed against the vertical connecting member 10.

When the vertical connecting member 10 indicates verticality, the post 2 is temporarily fixed with a temporary post or the like. Under this state, concrete is poured into the foundation hole. Concrete is poured up to the lower surface of the ground level connecting member 23 to form the concrete foundation 5, and the curing thereof is waited for.

(3) Construction of Post

When the concrete of the concrete foundation 5 is cured, the construction of the post 2 is completed. Thereafter, the temporary post is removed. Thereafter, to the post 2, the cover 30 is attached and the gutter 4 is attached. The roof member 1*e* is further attached. Thus, the construction of the roof structure such as a carport is completed.

According to the construction method of the present embodiment, a level, which is a construction tool, is pressed against the vertical connecting member 10 to confirm that the vertical connecting member 10 is positioned vertically to the ground level, thereby enabling to confirm that the post 2 is tilted accurately at a desired angle against the ground level. This facilitates the construction of the carport C.

As described above, since the vertical connecting member 10 indicates verticality, the post 2 is tilted on the basis of the indication, thereby enabling to easily and surely construct the carport C.

Embodiments of $8^{th}$ and $9^{th}$ Inventions

The $8^{th}$ invention (invention according to claim 8) specifies "a roof structure comprising a roof supported by a post." The present invention includes not only a roof structure having a post attached to a rear end of a roof, but also a roof structure having a post attached to a middle of a roof in a front-back direction, in the $5^{th}$ invention.

In the above-described roof structure, the post is tilted, and includes two post members and a vertical connecting member connecting the post members. The vertical connecting member is installed vertically to a ground level.

The two post members are connected to each other at the lower ends thereof by a lower end connecting member having an L-shape in cross section.

Embodiment of $10^{th}$ Invention

The present embodiment is a construction method of the roof structure according to the $8^{th}$ invention, and includes the step of fixing the post in the ground while keeping the vertical connecting member vertical to the ground level.

INDUSTRIAL APPLICABILITY

The targets of the $1^{st}$ to $10^{th}$ inventions are of the type of a roof structure including a roof supported by a post. The targets include a garage (a carport), a bicycle parking lot (a cycle port) for storing bicycles, and a corridor installed in a place for people to walk on. The present inventions are not limited thereto.

The $1^{st}$ to $7^{th}$ inventions include any target as long as the target has a basic structure in which a post supports a roof in a cantilever manner, and is tilted.

The application targets according to the $8^{th}$ to $10^{th}$ inventions are not limited to the targets including the roof supported in a cantilever manner. In short, the present inventions include any target as long as the target has a basic structure in which the post of the roof structure is tilted.

REFERENCE SIGNS LIST

A, B, C CARPORT
1 ROOF
2 POST
3 SIDE PANEL
5 CONCRETE FOUNDATION
10 VERTICAL CONNECTING MEMBER
21 POST MEMBER
22 POST MEMBER
23 GROUND LEVEL CONNECTING MEMBER
25 LOWER END CONNECTING MEMBER

What is claimed is:

1. A roof structure comprising:

a post which is made of aluminum and comprises two post members parallel to each other; and a roof supported by only the post, wherein the roof structure is a cantilever structure having a front end of the roof formed in a free end and a rear end connected to an upper end of the post, a lower end of the post is buried and fixed in a concrete foundation in a ground, a rear end of the concrete foundation is positioned in front of the rear end of the roof, the post is tilted with the upper end directed backward and with the lower end directed forward, and a tilting angle of the post against a ground level is 65 to 85 degrees.

2. The roof structure according to claim 1, wherein the post includes a vertical connecting member connecting the two post members, and the vertical connecting member is installed vertically to a ground level.

3. The roof structure according to claim 1, wherein the two post members are connected to each other at lower ends by a lower end connecting member having an L-shape in cross section.

4. A construction method of the roof structure according to claim 2, the construction method comprising the step of:

fixing the post in the ground, while keeping the vertical connecting member vertical to the ground level.

5. A roof structure comprising:

a roof, a post comprising two post members, which support the roof, and a vertical connecting member, which connects the two post members to each other, wherein the post is tilted with respect to a ground level, and the vertical connecting member is provided vertically to the ground level; and the two post members are connected to each other at lower ends by a lower end connecting member having an L-shape in cross section.

6. A construction method of the roof structure according to claim 5, the construction method comprising the step of:

fixing the post in the ground, while keeping the vertical connecting member vertical to the ground level.

* * * * *